US007011422B2

(12) United States Patent
Robertson et al.

(10) Patent No.: US 7,011,422 B2
(45) Date of Patent: Mar. 14, 2006

(54) ILLUMINATED POWER STRIP AND ELECTRICAL OUTLET

(76) Inventors: Jonas J. Robertson, 2521 Orbit Ct., Harvey, LA (US) 70058; Robert M. Currie, 325 Bavignon, Dollard-Des-Ormeaux, Quebec (CA) H9B1Y4

( * ) Notice: Subject to any disclaimer, the term of this patent is extended or adjusted under 35 U.S.C. 154(b) by 39 days.

(21) Appl. No.: 10/685,593

(22) Filed: Oct. 16, 2003

(65) Prior Publication Data

US 2004/0150984 A1 Aug. 5, 2004

Related U.S. Application Data

(60) Provisional application No. 60/423,351, filed on Nov. 4, 2002, provisional application No. 60/418,564, filed on Oct. 16, 2002.

(51) Int. Cl.
*F21V 33/00* (2006.01)

(52) U.S. Cl. ..... 362/95; 362/311; 362/355; 362/555; 362/612; 200/310; 340/656

(58) Field of Classification Search ..... 362/95, 362/253, 307, 311, 351, 355, 555, 612; 200/310; 340/656

See application file for complete search history.

(56) References Cited

U.S. PATENT DOCUMENTS 4,617,613 A * 10/1986 Rice ..... 362/95
4,774,641 A * 9/1988 Rice ..... 362/95
5,473,517 A * 12/1995 Blackman ..... 362/95
5,485,356 A * 1/1996 Nguyen ..... 362/95
5,552,907 A * 9/1996 Yokota et al. ..... 349/62
6,172,301 B1 * 1/2001 Goodsell ..... 174/66
6,350,039 B1 * 2/2002 Lee ..... 362/95
6,423,900 B1 * 7/2002 Soules ..... 174/66
6,431,719 B1 * 8/2002 Lau et al. ..... 362/95
6,547,411 B1 * 4/2003 Dornbusch ..... 362/95
6,578,980 B1 * 6/2003 Chen et al. ..... 362/95
6,648,496 B1 * 11/2003 Elghoroury et al. ..... 362/555
6,808,283 B1 * 10/2004 Tsao ..... 362/95
2005/0135103 A1 * 6/2005 Evans ..... 362/276
2005/0152128 A1 * 7/2005 Campman ..... 362/95

* cited by examiner

*Primary Examiner*—Alan Cariaso
*Assistant Examiner*—Jason Han
(74) *Attorney, Agent, or Firm*—Merek, Blackmon & Voorhees, LLC

(57) ABSTRACT

A decorative, illuminated electrical wall outlet cover plate having an LED light source and a translucent face plate. A method and arrangement is described for illuminating a electrical wall outlet to provide an easily changeable, decorative face plate for matching the walls, wallpaper, furniture or other decorative items in a room. The cover plate is made from an acrylic or polycarbonate plastic that can be clear, translucent, transparent, or partially opaque. Preferably, a reflective backing is provided to reflect light in the desired direction and to enhance the effective brightness of the light. In a second embodiment, a power strip is illuminated to more easily locate the plug in area of the power strip.

19 Claims, 2 Drawing Sheets

Illuminated Face Plate

Illuminated Face Plate

ILLUMINATED POWER STRIP AND ELECTRICAL OUTLET

CROSS REFERENCE TO RELATED APPLICATIONS

This application claims the benefit of U.S. Provisional Application 60/418,564, filed Oct. 16, 2002, entitled Illuminated Power Strip, which is hereby incorporated by reference. This application also claims the benefit of U.S. Provisional Application 60/423,351, filed Nov. 4, 2002, entitled Optical Conductor Illuminated Electrical Outlet, which is hereby incorporated by reference.

BACKGROUND OF THE INVENTION

1. Field of the Invention

The present invention relates to illuminated electrical outlets and power cords.

2. Description of the Prior Art

Electrical power outlets are necessary and important but almost invisible features in every house or building. We never notice them but would find it strange to enter a building that has none. In both the arenas of personal dwellings and office space, personal style and individualism have entered into the decor and even the architecture of the building. A lot of companies now use a vast array of lights, colors and imagery in an attempt to convey a certain message about their business. In the same manner, individuals also use lights, colors, and imagery to "set the mood" of the style and flair represented in their home or business. It has gotten to the point wherein what used to be standard now has become personalized. For instance, telephones used to come in a basic style and color, now there are phones of all styles, colors and shapes. Likewise, the light switch on the wall used to always be cram or white, now you can replace the standard plate with plates of all different sizes, shapes and colors.

For the most part, there has not been much change to the electrical power outlet except for illumination of the outlet plate to assist the users in finding the plate in the dark. Consumers would love to have the ability to customize their wall plates to have different and magnificent colors one day and a totally new design color the next day. By having the means to replace or change the electrical outlet within a matter of seconds, the user can truly "customize"his or her office space, house, etc. There is, therefore, a need for an optical conductor illuminating outlet receptacle that is dimensioned and configured to illuminate with a plurality of vibrant colors, is easily replaceable without danger to the user, is inexpensive and provides a light source inside the receptacle that assists users in finding the receptacle in the dark as well as a functional night light.

None of the above inventions and patents, taken either singly or in combination, is seen to describe the instant invention as claimed.

SUMMARY OF THE INVENTION

Accordingly, it is a principal object of the invention to provide a novel method and apparatus for illuminating an electrical wall outlet, power strip, extension cord or other electrical outlet.

It is another object of the invention to provide a low power consumption, yet durable arrangement for lighting an electrical outlet.

It is a further object of the invention to provide a easily changeable lighting system for an electrical outlet.

Still another object of the invention is to provide an arrangement for lighting an outlet that can change colors or utilize other light effects without switching out components of the lighting arrangement.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention relates to an optical conductor electrical outlet that illuminates and replaces the traditional power electrical outlet. Once installed, is easily replaced with another optical conductor electrical outlet.

Figures 1, 2:
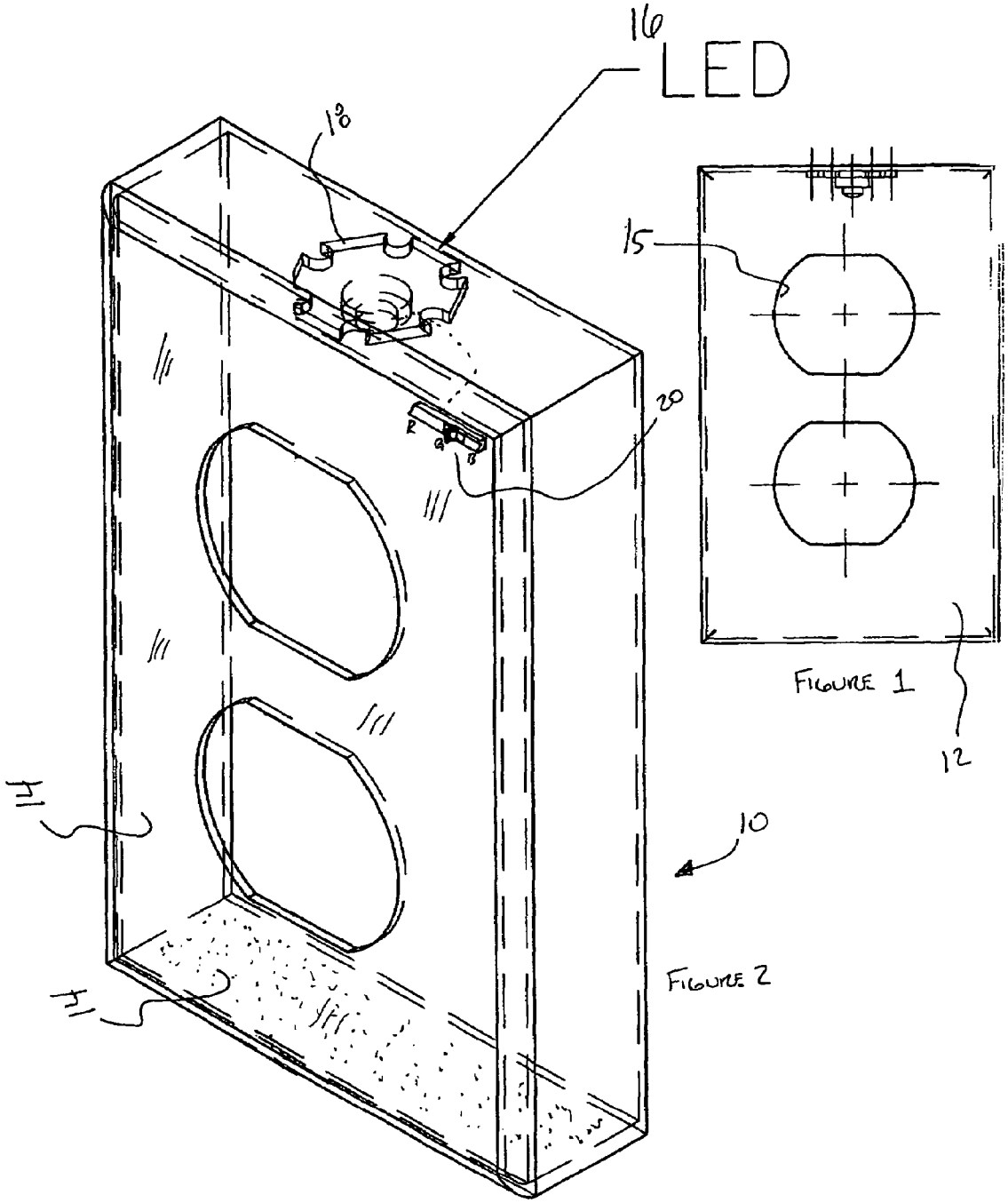
FIG. 1 is front elevational view of an electrical wall outlet according to the present invention.
FIG. 2 is an environmental perspective view of the electrical wall outlet according to the present invention.

As shown in FIGS. 1 and 2, an optical conductor cover plate 10 is provided for replacing a standard electrical wall outlet cover plate (not shown) to form an optical conductor electrical wall outlet. The cover plate 10 mounts by screws, quick connects or other conventional connectors (not shown) to a junction box or other standard electrical outlet mounting hardware and is sized to receive individual electrical sockets in the frontal openings 15. The front face 12 of the cover plate may connect to the cover plate 10 by quick connect, snaps or other known connectors.

The optical conductor electrical outlet has within it conventional electrical prongs, necessary wiring, the holes for receiving the prongs of the power cord and a light source for illuminating the optical conductor electrical outlet embodiment. The electrical outlet cover plate 12 like a circuit breaker or electrical switch coverplate can snap in and out easily. The light source can be, but is not limited to, a small conventional light source or preferably, an LED mounted within or approximate to the optical conductor electrical outlet. The necessary voltage step-down transformer (from A/C to D/C) or rectifier, is typically 2.0 to 4.0 volts D/C. The transformer or rectifiers are also mounted within or in proximity to the optical conductor electrical outlet.

There are numerous ways to increase the illumination of the optical conductor electrical outlet. One way is to start with a clear, light transmissive optical conductor material to construct the face plate 12 or entire cover plate 10. A reflective element 14, usually a white resin strip added during manufacture is placed behind or on the interior walls of the cover plate. Alternatively, a white acrylic paint or white tape 14 can be added after the manufacture of the optical conductor electrical outlet (but not limited to white) on the bottom, top or side of the optical conductor electrical outlet. A LED 16 is provided within the cover plate to illuminate the cover plate from within. The effect is to hide the interior components of the electrical wall outlet. The outlet appears white during daytime hours with the reflective white layer 14 clearly visible through the face plate 12. At night when the LED is illuminated, the optical conductor electrical outlet glows brightly, with the majority of the light reflected outward directly from the LED 16 or by the reflector 14.

The LED is preferably a colored Light Emitting Diode ("RGB LED"). Another way to illuminate the optical conductor is to use a colored light transmissive optical conductor material having a reflective element placed on the bottom, back or side using a white LED. The white LED illuminates white, but appears to illuminate in the color of the resin that is added in the process of manufacturing to the light transmissive optical conductor material. The optical conductor electrical outlet can also be coated with any color acrylic paint or conductor elements a reflective material can be coated over them to enhance the illumination qualities of the optical conductor electrical outlet and hide the copper conductor and the other electrical elements.

The LED can be replaced by the user. The LED has a quick connect/disconnect feature that utilizes a threaded, interference or snap in fit 18. As with a telephone wire connection, the LED may have a snap connection with a quick snap release. This allows the user to replace the LED without having to replace the whole apparatus. Conversely, it is possible to have an inexpensive and easy way to change the whole apparatus. The user simply pulls out or unscrews the optical conductor electrical outlet and replaces it with a new optical conductor electrical outlet using a different color light transmissive optical conductor material. This method of quick disconnect has not been used in outlets because until now, there was no need to change the outlets.

An RGB LED can also be used to give the device capability of changing colors, with preferably a slide mechanism 20 placed on the outside of the face plate 12 of the outlet 10 can be used to change the outlet to any color using the RGB LEDs 16. With this present invention, a person will be able to change the color of their outlet and coordinate it with the wallpaper or paint by moving a switch to select the color.

The optical conductor electrical outlet is made of clear or colored light transmissive material. There are numerous processes that will yield the proper type of optical conductor transmissive material needed for the maximum amount of illumination. Some of the processes include extrusion, co-extrusion, casting and injection molding and such. Through the process of co-extrusion, different colors can be added to the acrylic and when a white light is shone through the different colored light transmissive optical conductor electrical outlet, each individual color will show through. By adding color pigmentation during the process of forming the light transmissive material over the conductive elements and by adding a reflective coating, an optical conductor electrical outlet can be made to light any color desired. Another method of achieving any color optical conductor electrical outlet is by adding a white resin pigmentation (between 0.03 to 0.09 of 100%) mixed with light transmissive material, the light transmissive material in the outlet will appear translucent or transparent, and when a colored LED is applied, the color of the LED will shine through the light transmissive material and will take on the color of the LED. The optical conductor electrical outlet can be retrofitted to the standard electrical power outlet including, but not limited to, the GFI circuit or any other wall switch cover plate, conventional outlet, power strip, or electrical adapters.

In addition to the Red-Green-Blue ("RGB") color slide controlling the color of the light of the LED, other decorative controls could be provided to further control the lighting effects. For instance, the lights could strobe, flash, or flash relative to a sensed condition such as music or lighting level. A dimmer or other device could also be used to control the light level of the LEDs. The light could also dim in reverse proportion to the amount of ambient light, such that the LED is powered off during daylight and powered on at night or in darkness. Multiple LEDs could also be provided around the cover plate 10 and could be controlled as a group or separately.

Figure 3:
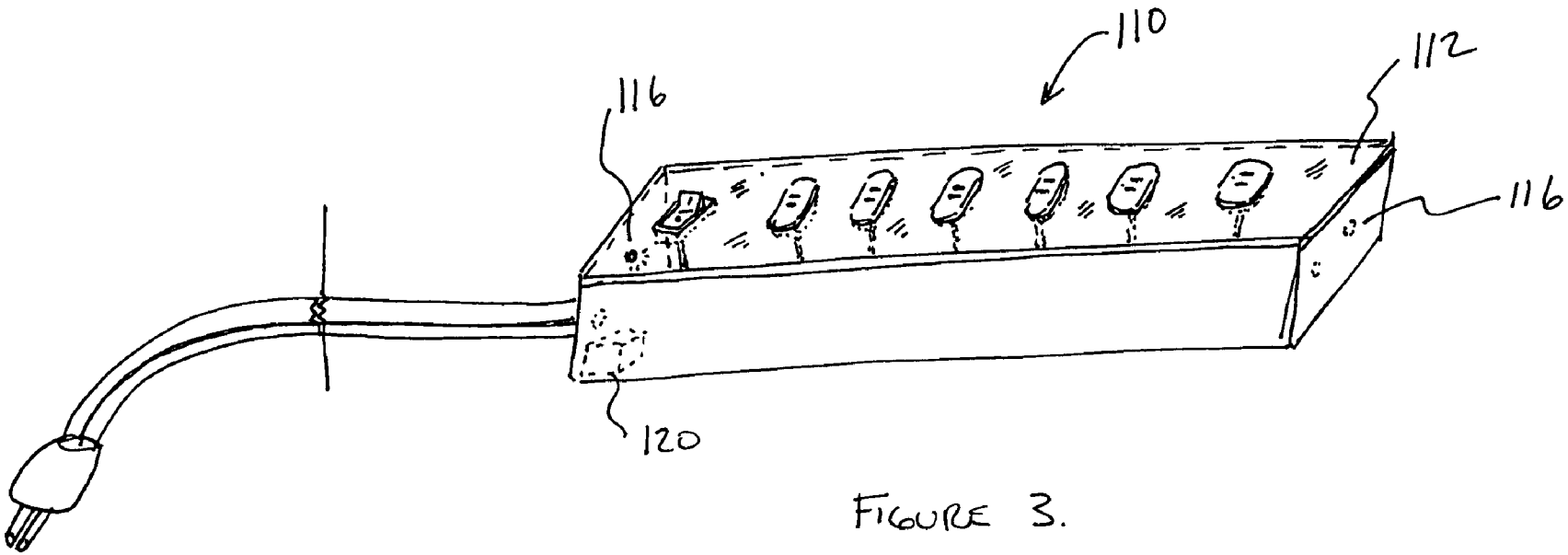
FIG. 3 is an environmental perspective view of a power strip according to a second embodiment of the invention.

In a further embodiment shown in FIG. 3, a power strip ("extension cord") 110 can be illuminated to make location of the plug-in area easier to identify. In a manner similar to the electrical outlet, the face, plug-in area 112 can be lit by a number of LEDs 116 or conventional lights. A 1.2 watt LED with 18 lumens can be placed within a transparent/translucent power strip 110 to illuminate the outlet. A cluster of 5 mm LEDs could also be used along the perimeter to distribute the light source. A suitable voltage step down transformer and/or rectifier 120 can be provided within the power strip to power a suitable power source for the LEDs.

Additionally, the entire length or a portion of the length of the power strip face 112 can be made of acrylic to illuminate the entire power strip. To focus the light to the face of the power strip and to reduce the power required to illuminate the desired areas, the secondary surfaces such as the bottom and sides of the power strip can be painted or coated with a white reflective, glossy surface to reflect the light to the desired location. The reflective surface can be added after the acrylic is formed, or can be co-extruded therewith. While the upper surface 112 is shown as transparent, the upper surface is preferably partially opaque to hide the interior electrical components of the power strip while still allowing the power strip to be illuminated. This can be done by adding optically conductive materials or other resins to the acrylic or polycarbonate pellets used to form the face 112 of the power strip. The resins appear opaque under external lighting, but glow bright white when illuminated by an internal white light source 116.

A single LED can be used, such as a super bright LED ("high intensity LED"), or each outlet can be lit by a separate LED or group of LEDs. In a preferred embodiment, each LED is lit by a LED having a different color. Red Green Blue ("RGB") LEDs can be used to light different colors in different ways, or to provide the ability to selectively control and change the color of an LED as discussed in reference to the first embodiment of an electronic wall outlet cover plate.

It is to be understood that the present invention is not limited to the sole embodiment described above, but encompasses any and all embodiments within the scope of the following claims.

We claim:

1. A method of illuminating an electrical component cover plate having an outer surface and an inner surface, said cover plate comprising:

providing a translucent cover plate having an LED, said LED being removably connected to said cover plate;

providing a reflective surface to said inner surface of said cover plate;

providing a step down transformer circuit for converting power from said electrical component to said LED and, providing a quick connect and disconnect LED which allows said LED to be removed from said cover plate and replaced without removing or replacing said cover plate wherein said LED is a multi-color LED and said cover plate having a manually operable switch mounted thereon whereby said switch includes a plurality of positions with each of said positions corresponding to a different color of light emitted from said LED such that by moving said switch from a first position to a second position, the color of light emitted by said multi-color LED can be changed.

2. The method of claim 1, wherein said cover plate is polycarbonate.

3. The method of claim 2, including the additional step of mixing said polycarbonate with an optically conductive material.

4. The method of claim 2, including the additional step of mixing said polycarbonate with an optically conductive material to form a unidirectional opaque cover plate.

5. The method of claim 1, wherein said cover plate is acrylic.

6. The method of claim 1, wherein said cover plate includes a switch for changing the color of the LED responsive to a sensed condition.

7. The method of claim 1, wherein said cover plate includes a control for changing powering the LED responsive to a sensed condition.

8. The method of claim 1, wherein said cover plate is translucent.

9. The method of claim 1, wherein said cover plate is transparent.

10. The method of claim 1, wherein said LED is a white 1.2 watt LED.

11. An optical conductor electrical outlet comprising:

a cover plate having walls forming an interior space within said walls, each of said walls having an interior facing surface and said interior facing surfaces being coated with light reflective material;

an LED mounted to one of said walls so that the light emitting portion of said LED shines light into said interior and said light is reflected by said light reflective material;

a face mounted substantially perpendicular to said walls, said face being constructed of light transmitting material which permits passage of said reflected light therethrough said face including an electrical outlet; and a step down transformer circuit mounted to said cover plate for converting power from an power source to said LED.

12. The optical conductor electrical outlet as set forth in claim 11, further comprising:

a quick connect and disconnect LED which allows said LED to be removed from said cover plate and replaced without removing or replacing said cover plate.

13. The optical conductor electrical outlet as set forth in claim 11, wherein; said LED is a multi-color LED and said cover plate having a manually operable switch mounted thereon whereby said switch includes a plurality of positions with each of said positions corresponding to a different color of light emitted from said LED such that by moving said switch from a first position to a second position, the color of light emitted by said multi-color LED can be changed.

14. The optical conductor electrical outlet as set forth in claim 11, wherein; said cover plate is acrylic.

15. The optical conductor electrical outlet as set forth in claim 11, wherein; said cover plate is polycarbonate.

16. The optical conductor electrical outlet as set forth in claim 11, wherein; said face is translucent.

17. The optical conductor electrical outlet as set forth in claim 11, wherein; said face is transparent.

18. The optical conductor electrical outlet as set forth in claim 11, wherein; said cover plate includes a switch for changing the color of the LED responsive to a sensed condition.

19. The optical conductor electrical outlet as set forth in claim 11, wherein; said cover plate includes a control for changing powering the LED responsive to a sensed condition.

* * * * *